US006203303B1

(12) United States Patent
Fujiwara et al.

(10) Patent No.: US 6,203,303 B1
(45) Date of Patent: Mar. 20, 2001

(54) VANE PUMP

(75) Inventors: Hidetoshi Fujiwara, Aichi-ken; Motoyasu Yamamori, Nagoya; Kentaro Yamauchi, Chiryu, all of (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/457,336

(22) Filed: Dec. 9, 1999

(30) Foreign Application Priority Data

Dec. 11, 1998 (JP) ..... 10-353406

(51) Int. Cl.[7] ..... F01C 1/00

(52) U.S. Cl. ..... 418/269; 418/81; 418/82; 418/268

(58) Field of Search ..... 418/81, 82, 268, 418/269

(56) References Cited

U.S. PATENT DOCUMENTS

| | | | | |
|---|---|---|---|---|
| 4,386,891 | * | 6/1983 | Riefel et al. | 418/269 |
| 4,610,614 | * | 9/1986 | Haga et al. | 418/269 |
| 4,611,977 | * | 9/1986 | Shibuya et al. | 418/268 |
| 5,154,593 | * | 10/1992 | Konishi et al. | 418/268 |
| 5,188,522 | * | 2/1993 | Hara | 418/268 |
| 5,226,802 | * | 7/1993 | Nakamura et al. | 417/299 |
| 5,490,770 | * | 2/1996 | Oogushi | 418/268 |

FOREIGN PATENT DOCUMENTS

| | | | | |
|---|---|---|---|---|
| 4119207 | * | 12/1991 | (DE) | 418/269 |
| 2315815 | * | 11/1998 | (GB) | 418/268 |
| 60-256580 | * | 12/1985 | (JP) | 418/268 |
| 63-147980 | * | 6/1988 | (JP) | 418/268 |
| 63-167089 | * | 7/1988 | (JP) | 418/268 |
| 64-080784 | * | 3/1989 | (JP) | 418/268 |
| 2-108881 | * | 4/1990 | (JP) | 418/268 |
| 7-29261 | | 7/1995 | (JP) . | |
| 7-217548 | | 8/1995 | (JP) . | |
| 9-32740 | | 2/1997 | (JP) . | |

* cited by examiner

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

A vane pump is composed of a rotor that is rotatably disposed in a cam ring attached to a housing, a plurality of vanes that are slidably disposed in corresponding slits formed in the rotor in which the vane is projected from the slit upon rotation of the rotor, a pair of sidewall members that close both side portions of the cam ring to form a cavity defined by the cam ring and said sidewall members, a plurality of annular backpressure grooves that is depressively formed on contact surfaces of the sidewall members with the rotor in which adjacent two of the backpressure grooves are communicated with each other through a communication passage to introduce discharged pressure into an inside end portion of each of the slits, and depressions that are formed on at least one of the contact surfaces of the sidewall members with the rotor in which the depressions are not contacted with a part of side surface of each of the vanes.

9 Claims, 7 Drawing Sheets

VANE PUMP

BACKGROUND OF THE INVENTION

1. Field of the Invention

The present invention relates to a vane pump used as a hydraulic source of a power steering apparatus, more particularly, to such a vane pump in which ability in projection of vanes is enhanced when a rotation of a rotor of the pump is started.

2. Description of the Related Art

Conventionally, there is of such a vane pump described in Japanese Patent Publication (Kokai) No. 9-32740 (1997).

In such a conventional vane pump, it is composed of a rotor rotatably disposed in a cam ring, plural vanes projectably provided in corresponding slits formed in the rotor, and a pair of sidewall members (an end surface of a body and a side plate) provided to close both side portion of the cam ring. With this configuration, a pump operation is performed with rotation of the rotor as the vane slidably contacts its top portion and its side surfaces with an inner surface of the cam ring and with surfaces of the side wall members facing with the vane.

In such a vane pump, it is appeared such a phenomenon that the pump operation is not started immediately when the rotation of the rotor of the pump is started, because the vane is not sufficiently projected from the slit of the rotor.

After the pump has been driven, the vane is projected until its top portion contacts the inner surface of the cam ring by discharged pressure of the pump that is introduced into a backpressure groove formed in each of the sidewall members. However, just after the rotation of the rotor of the pump is started in a condition that the pumping operation is not started, only a centrifugal force upon rotation of the rotor contributes on the projection of the vane, so that the projection thereof cannot sufficiently performed in such a condition.

As a result of an analysis of this phenomenon in the applicant, when a vane 60 in slit 510 formed in a rotor 50 is rotated with the rotor 50, pressing force "F" that presses the vane 60 onto one of inside walls of the slit 510 (backward in a rotational direction of the rotor 50) acts on the vane 60, as shown in FIG. 1. Therefore, the projection of the vane 60 is prevented by this pressing force "F". As a result of further analysis, it is discovered such that the phenomenon that the vane 60 is pressed onto the inside wall of the slit 510 is caused by slide resistances of the side surface of the vane 60 with inside surface of the both sidewall members.

SUMMARY OF THE INVENTION

Accordingly, an object of the present invention is to provide a vane pump in which projection of vanes is improved by reducing slide resistance that is caused with side surfaces of the vane contacting inside walls of sidewall members just when a rotation of a rotor of the pump is started.

Briefly, a vane pump according to the present invention is composed of a rotor that is rotatably disposed in a cam ring attached to a housing, a plurality of vanes that are slidably disposed in corresponding slits formed in the rotor in which the vane is projected from the slit upon rotation of the rotor, a pair of sidewall members that close both side portions of the cam ring to form a cavity defined by the cam ring and the sidewall members, a plurality of annular backpressure grooves that are depressively formed on contact surfaces of the sidewall members with the rotor in which adjacent two of the backpressure grooves are communicated with each other through a communication passage to introduce discharged pressure into an inside end portion of each of the slits, and depressions that are formed on at least one of the contact surfaces of the rotor with the sidewall members in which the depressions are not contacted with a part of side surfaces of each of the vanes.

With this configuration, a slide resistance in the contact area of the side surface of the vane with the both sidewall members is reduced, so that pressing force that presses the vane onto an inside surface of the slit (backward in the rotational direction of the rotor) is diminished. Namely, the pressing force that prevents the vane from projecting when the rotation of the rotor of the conventional vane pump is started is diminished, so that a pump operation is smoothly started just when the pumping operation is initiated.

Further, the vane pump according to the present invention includes such a construction that each of the depressions is formed radially outside of the backpressure groove within a range at least where the backpressure groove is formed in a circumferential direction of the rotor. According to this configuration, it can be obtained such an effect similar to that in the prior configuration.

Furthermore, the vane pump according to the present invention provides such a configuration that each of the depressions is formed in an entire circumferential area from a pre-compression area of the pump to a discharge area in a rotational direction of the rotor. In this situation, the depression is formed in an area where the vane is most efficiently projected, so that the additional machining to the sidewall members can be performed in minimum.

The depression is continuously formed in the circumferential direction, so that it continuously can be machined by a cutting tool such as an end-mill. Therefore, the machining time can be diminished compared with that of the conventional pump. According to this configuration, it can be also obtained such an effect similar to that in the prior two configurations.

Moreover, the depression is formed so as to be communicated with the backpressure groove or the communication passage. With this configuration, a radial width of a portion that remains as a flat portion radially outside of the depression in a contact area of the rotor with each of the sidewall members can be formed to be larger than a case that the depression is formed independently of the backpressure groove and the communication passage. Therefore, ability in seal of the depression in the radial direction can be maintained sufficiently, and also the feature similar to all of the prior configuration can be obtained.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF THE PREFERRED EMBODIMENT

[First Embodiment]

Figure 1:
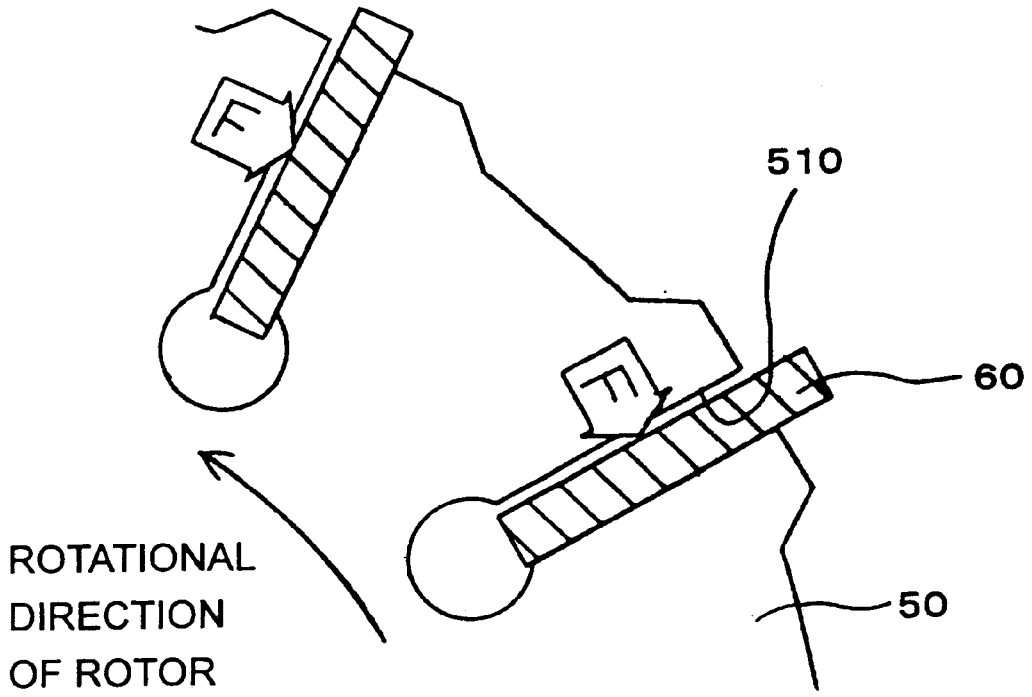
FIG. 1 PRIOR ART
FIG. 1 is an explanatory view of an operation in a conventional vane pump.
Figure 2:
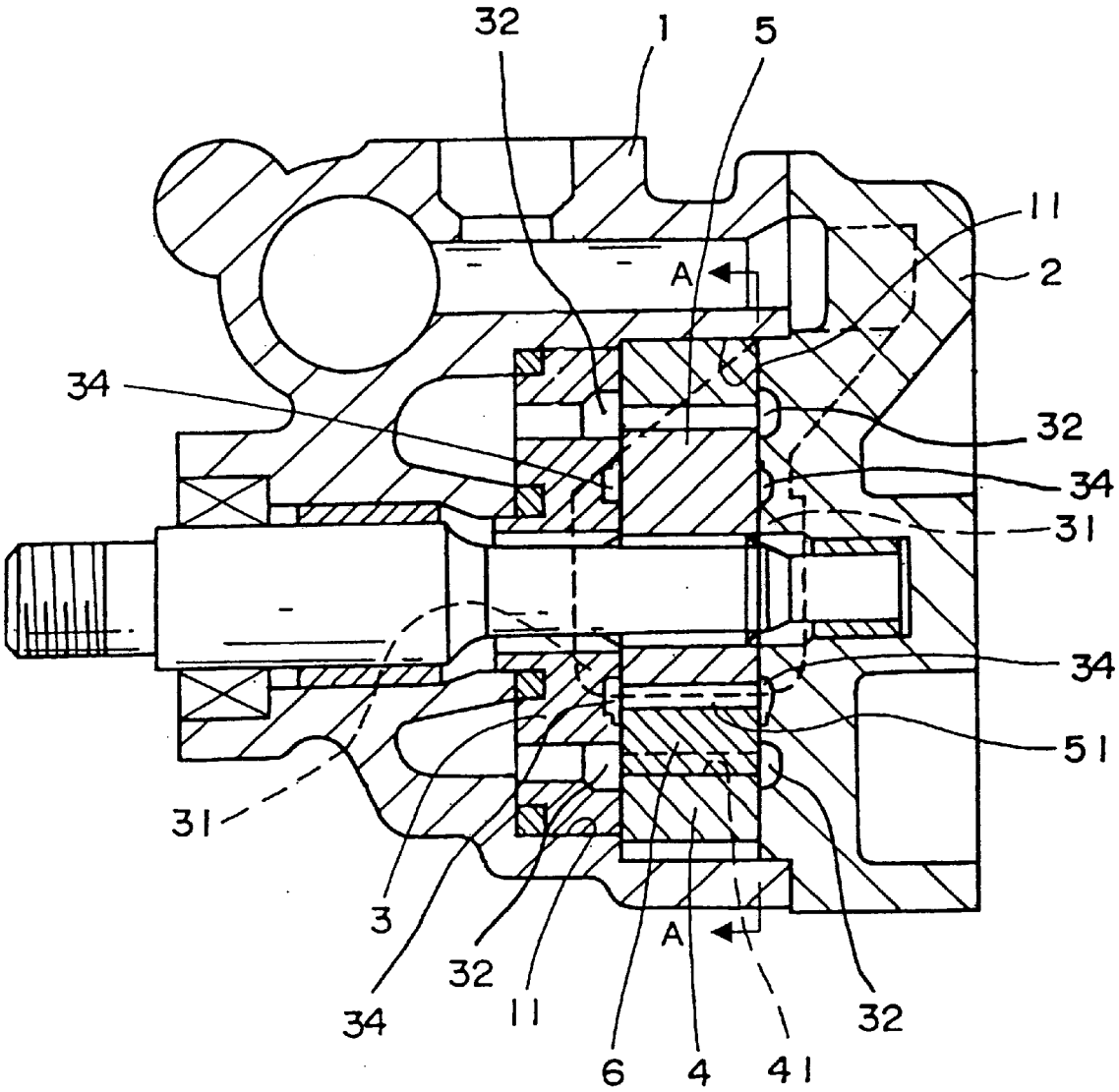
FIG. 2 is an entire cross-sectional view according to a first embodiment of the present invention.
Figure 3:
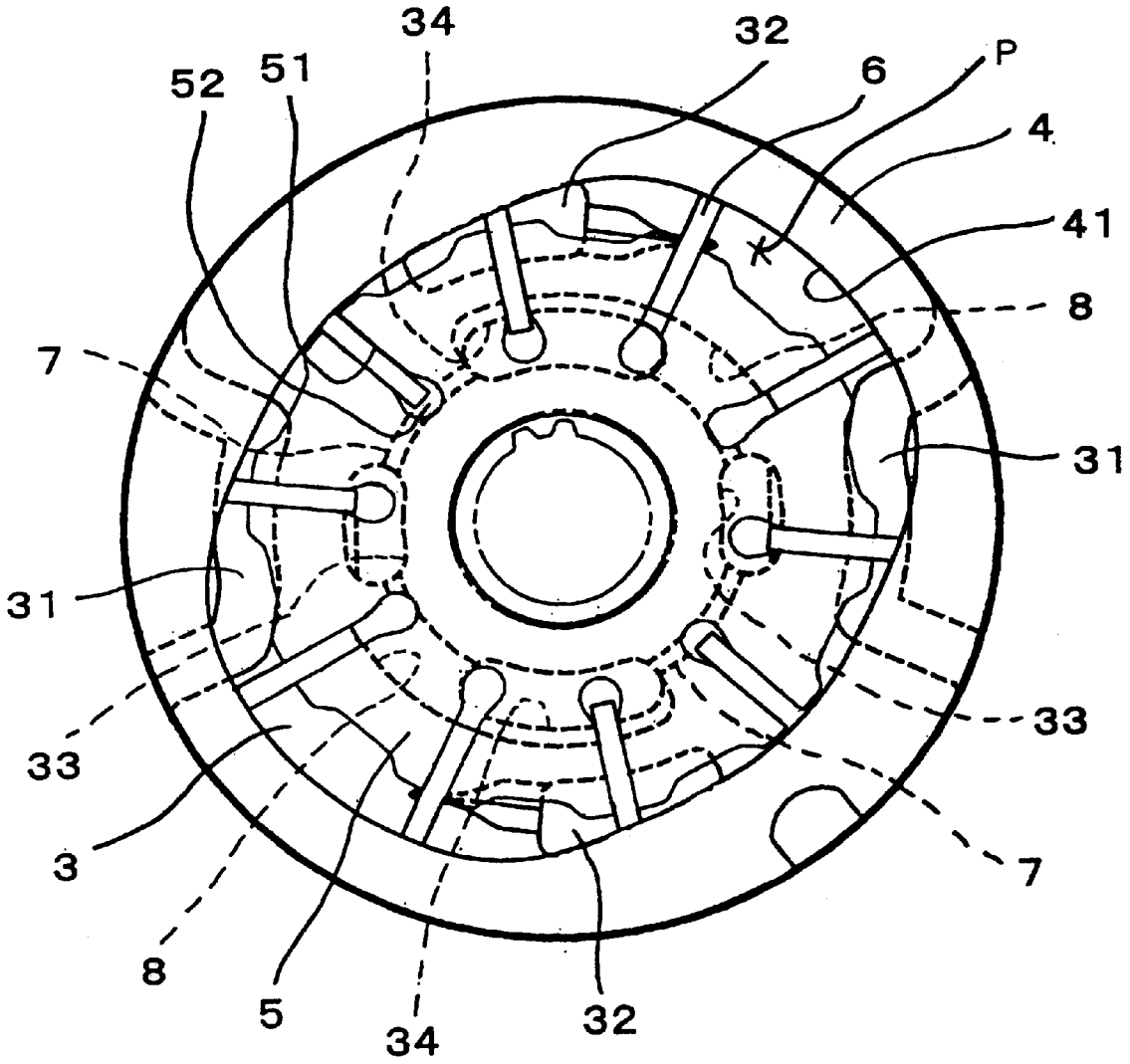
FIG. 3 is a cross-sectional view of the first embodiment taken along with the arrows A—A in FIG. 2.
Figure 4:
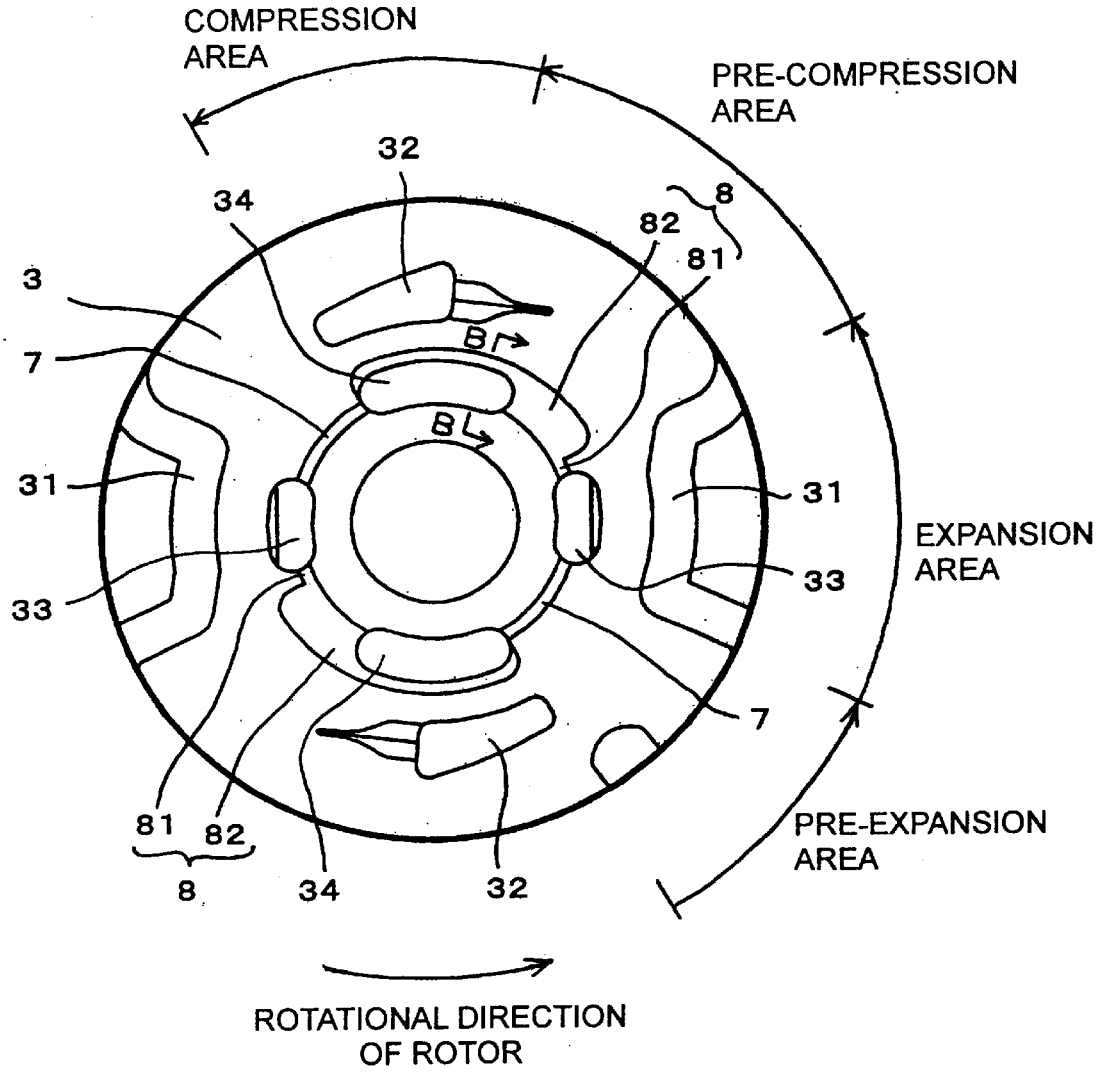
FIG. 4 is a top plan view of a side plate according to the first embodiment of the present invention.
Figure 5:
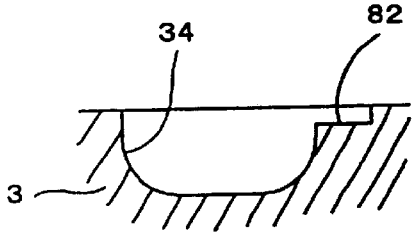
FIG. 5 is a cross-sectional view of the first embodiment taken along with the arrows B—B in FIG. 4.

A first embodiment according to the present invention will be explained hereinafter with reference to FIGS. 2–5.

Numeral 1 denotes a front housing in which a cavity 11 is formed by being closed a rear housing 2. In the cavity 11, a side plate 3 and a cam ring 4 are disposed, in which the side plate 3 and the rear housing 2 connectively face with one side of the cam ring 4 and the other side thereof, respectively. These side plate 3 and rear housing 2 function as sidewall members that close both side portions of the cam ring 4.

On an inner surface of the cam ring 4, there is formed a cam surface 41 that takes the form of an ellipse-curved surface whose cam curve period is 180°. A rotor 5 is rotatably disposed in the cam ring 4, in which plural slits 51 are radially formed to slidably support plural vanes 6 a top portion of which slidably contacts the inner surface of the cam ring 4. One side of the vane 6 is slidably contacted with the side plate 3, while the other side thereof is slidably contacted with the rear housing 2.

With this configuration, plural pump chambers P are formed between the cam surface 41 of the cam ring 4 and the rotor 5 with the adjacent two vanes 6, a volume of which is changed upon rotation of the rotor 5.

On inside surfaces of the rear housing 2 and the side plate 3 slidably contacting the rotor 5, there is a pair of suction ports 31 at a portion corresponding to an expansion area (suction area) symmetrically of a rotational center of the rotor 5, while there is a pair of discharge ports 32 at a portion corresponding to an compression area (discharge area) symmetrically thereof. In addition, a pair of backpressure grooves 33 and a pair of backpressure grooves 34 are depressively formed coaxially of the rotor 5 on the inside surface of the rear housing 2 and the side plate 3 at angular positions corresponding to the expansion and compression areas, respectively, which are communicated with backpressure chambers 52 formed at an end portion inside of the slit 51 of the rotor 5. Further, the suction side backpressure grooves 33 corresponding to the suction ports 31 are communicated with the discharge ports 32 through unillustrated passages.

Herein, the feature in this embodiment is of a shape of a communication passage depressively formed on the rear housing 2 and the side plate 3 to communicate the adjacent backpressure grooves 33 and 34.

A first communication passage 7 formed between the discharge side backpressure groove 34 corresponding to the discharge port 32 and the suction side backpressure groove 33 adjacently provided in a rotational direction of the rotor 5 is formed as a narrow groove with a same radial width along an entire length in a circumferential direction, so as to obtain an orifice effect. However, a construction of the first communication groove 7 is similar to that in a conventional vane pump.

On the other hand, a second communication passage 8 provided between the suction side backpressure groove 33 and the discharge side backpressure groove 34 adjacent thereto in the rotational direction of the rotor 5 is composed of an orifice portion 81 and a wide portion 82. The orifice portion 81 is so formed narrow at only a position close to the suction side backpressure groove 33, while a width of the wide portion 82 is so formed more wide than that of the discharge side backpressure groove 34 from the orifice portion 81 to the end of the discharge side backpressure groove 34 in the rotational direction of the rotor 5, namely along a generally entire area of a pre-compression area and the compression area in the circumferential direction. The wide portion 82 is formed as a part of the second communication passage 8, and also has a portion where the respective side surfaces of the vane 6 do not contact the rear housing 2 and the side plate 3. Therefore, the wide portion 82 serves as a depression that decreases a contact area in each of between the vane 6, the rear housing 2 and the side plate 3.

In each of the slidable contact surfaces of the rotor 5 with the rear housing 2 and the side plate 3, a width of the wide portion 82 is so set to remain enough width for seal in a flat portion between the wide portion 82 and the discharge port 32. Besides, each of the communication passages 7 and 8 is formed to be the same depth in its entirety which is generally one-fifth in depth of each the backpressure grooves 33 and 34. Accordingly, the second communication passage 8 has also orifice effect because the width of the second communication passage 8 is larger in the radial direction than that of the first communication passage 7.

The operation of this embodiment as constructed above will be explained hereinafter with reference to FIG. 6.

Figure 6:
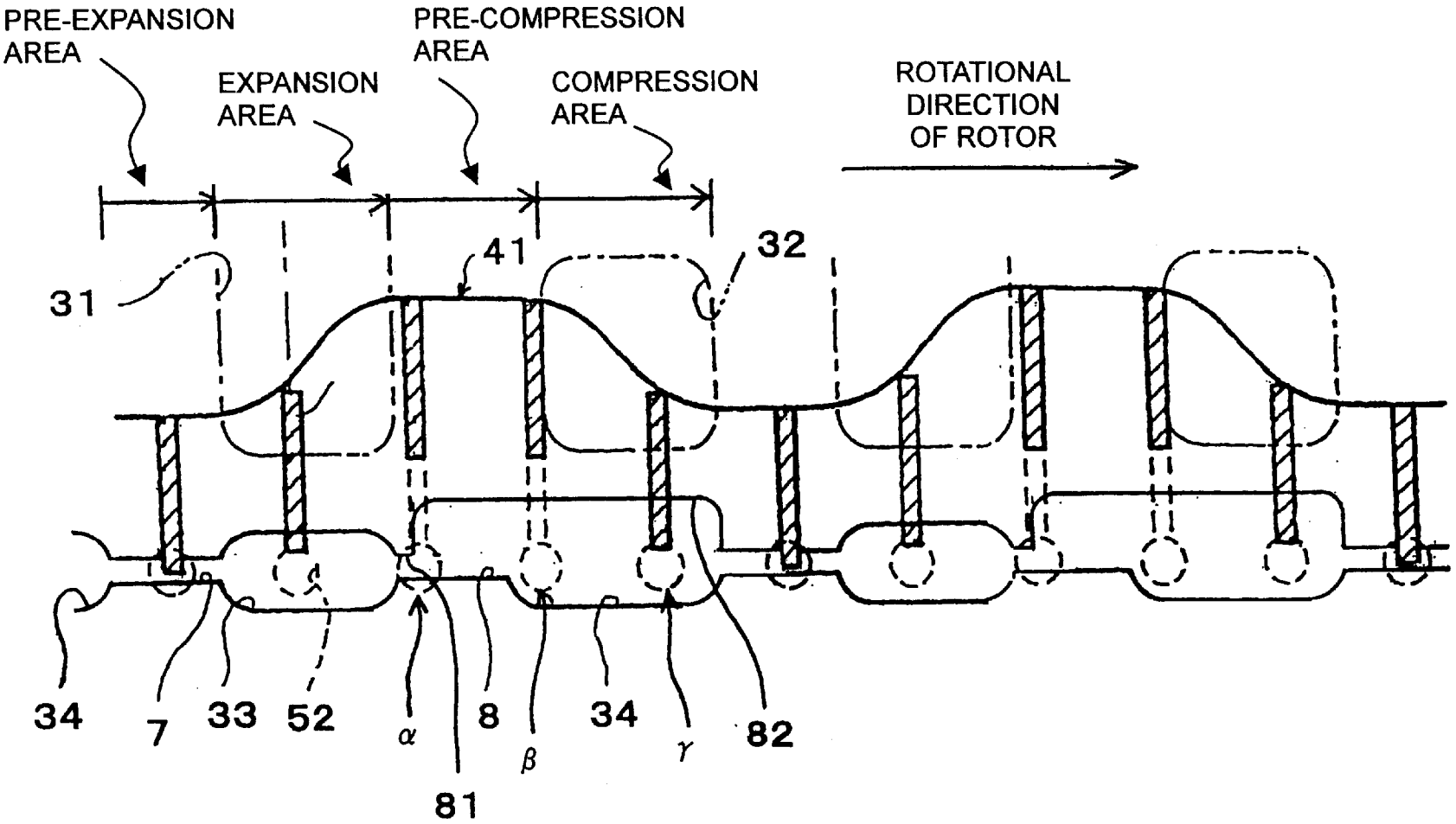
FIG. 6 is an explanatory diagram showing an operation according to the present invention.

When the rotation of the rotor 5 is started to drive the pump, only the centrifugal force upon rotation of the rotor 5 contributes on the projection of the vane 6 positioned at the pre-compression area (at a position "α" in FIG. 6). However, the respective contact areas of the both side surfaces of the vane 6 with the rear housing 2 and the side plate 3 can be reduced by the wide portion 82 of the second communication passage 8. Therefore, the pressing force "F" (see FIG. 1) that presses the vane 5 onto an inside surface of the slit 51 of the rotor 5 can be weakened based upon the reduction of the respective contact areas, so that the projection of the vane 5 can be enhanced by the centrifugal force upon rotation of the rotor 5.

Thus, the vane 6 existing at the pre-compression area (at the position "α") can be further projected compared with that in the conventional pump. In such a situation, the vane 6 in the compression area (at a position "γ") can be further pressed downward by the cam surface 41, so that an operational fluid in the discharge side backpressure groove 34 can be further compressed with this press-down operation.

At this time, since the both ends of the discharge side backpressure groove 34 in the rotational direction of the rotor 5 are temporarily closed by the first and second communication passages 7 and 8 having the orifice effect, the operational fluid compressed at the position "γ" acts on the end portion of the vane 6 existing at a position "β" adjacent to the opposite vane 6 in the rotational direction of the rotor 5 so as to project it.

Namely, the vane 6 is sufficiently pressed downward at the position "γ", so that the pressurized force of the operational fluid acts largely on the end portion of the vane 6 positioned at "β". Further, the respective contact areas of the vane 6 with the rear housing 2 and the side plate 3 can be reduced by the wide portion 82 of the second communication passage 8 at the position "β" also, so that the vane 6 can be further projected at this position without slide resistance of the vane 6 with the rear housing 2 and the side plate 3.

Thus, an ability of the vane 6 in projection can be improved, so that the pump operation in the vane pump according to this embodiment is started as possible as smoothly just when the rotation of the rotor of the pump is started.

Further, the wide portion 82 that is a depression is formed in a generally entire area from the pre-compression area of the pump to the discharge area adjacent thereto in the rotational direction of the rotor 5, namely at an area only where the smooth projection of the vane 6 is effectively operable. Therefore, the additional machining onto the rear housing 2 and the side plate 3 can be performed in minimum.

Since the wide portion such a depression is formed as a communication passage so as to be communicated with the discharge side backpressure groove 34, a radial width that remains as a flat portion radially outside of the wide portion 82 can be formed to be larger than that of the depression formed independently of the backpressure groove and the communication passage, on the respective contact areas of the vane 6 with the rear housing 2 and the side plate 3. Therefore, it can be sufficiently maintained such ability in seal of the depression between the suction port and the discharge port.

[Second Embodiment]

Figure 7:
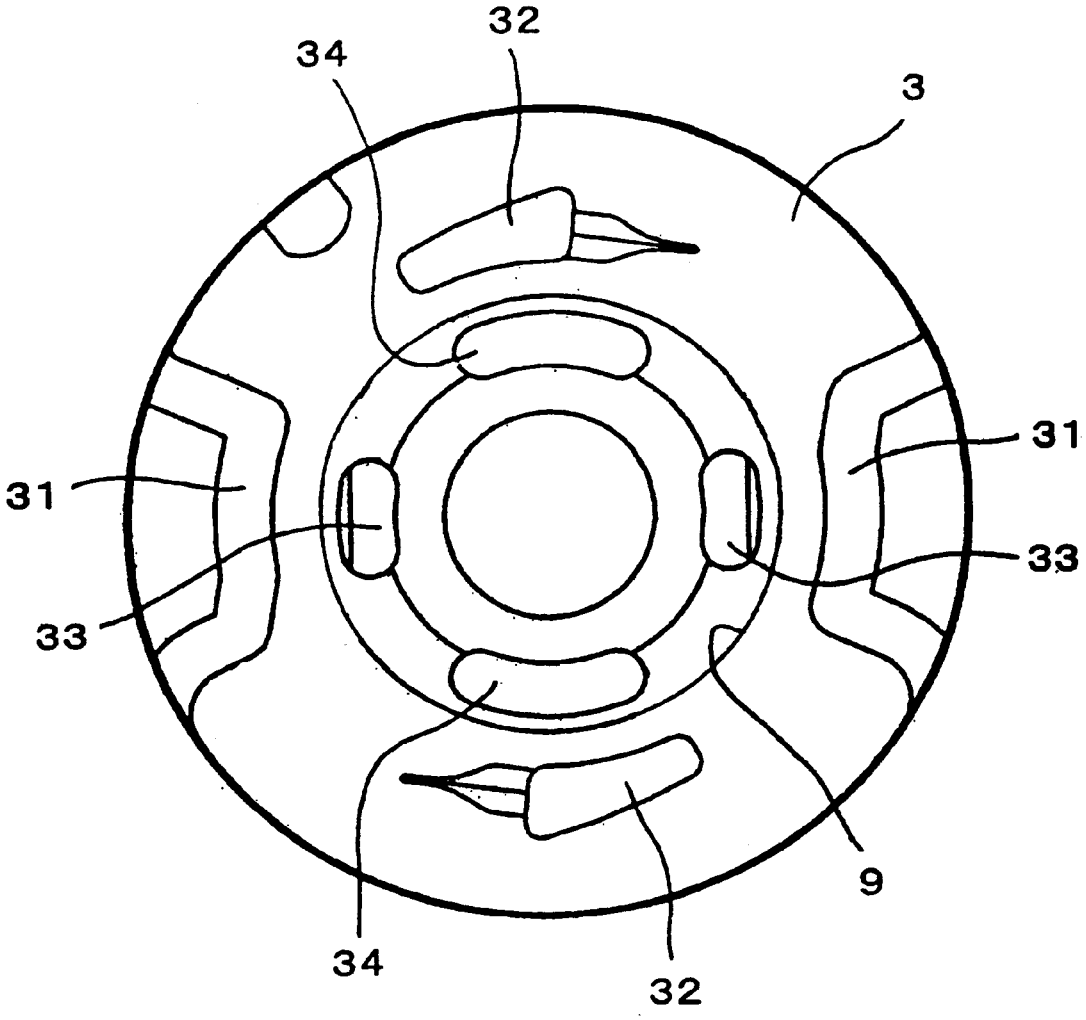
FIG. 7 is a top plan view of a side plate according to a second embodiment of the present invention.

Next, a second embodiment according to the present invention will be explained hereinafter with reference to FIG. 7.

In the first embodiment, two kinds of the communication passages 7 and 8 having different shapes are formed on the respective contact areas of the vane 6 with the rear housing 2 and the side plate 3. On the other hand, only one communication passage 9 whose width in the radial direction is same as that of the wide portion 82 (see FIG. 4) is formed as a depression instead of the first and second communication passages 7 and 8, in the second embodiment. However, the other portions or constructions except for the first and second communication passages 7 and 8 in the first embodiment are same as that in the second embodiment.

In this case, the orifice effect similar to that of the first and second communication passages 7 and 8 in the first embodiment can be obtained by forming the depth of the annular communication passage 9 to be sufficiently smaller than that of each the backpressure grooves 33 and 34.

By providing the annular communication passage 9 so constructed above, the contact areas of the both side surfaces of the vane 6 with the rear housing 2 and the side plate 3 can be reduced in the pre-compression area and the expansion area also. With this configuration, this embodiment can obtain the same operation as that in the first embodiment.

Further, the projection of the vane 6 can be also enhanced in the pre-expansion area and the expansion area, so that the pump operation can be smoothly started as possible as at the same time when the rotation of the rotor of the pump is started.

Furthermore, in a case that the annular communication passage 9 is machined by a cutting tool such an end-mill, it can be machined continuously, so that the machining time can be diminished in minimum.

[Third Embodiment]

Figure 8:
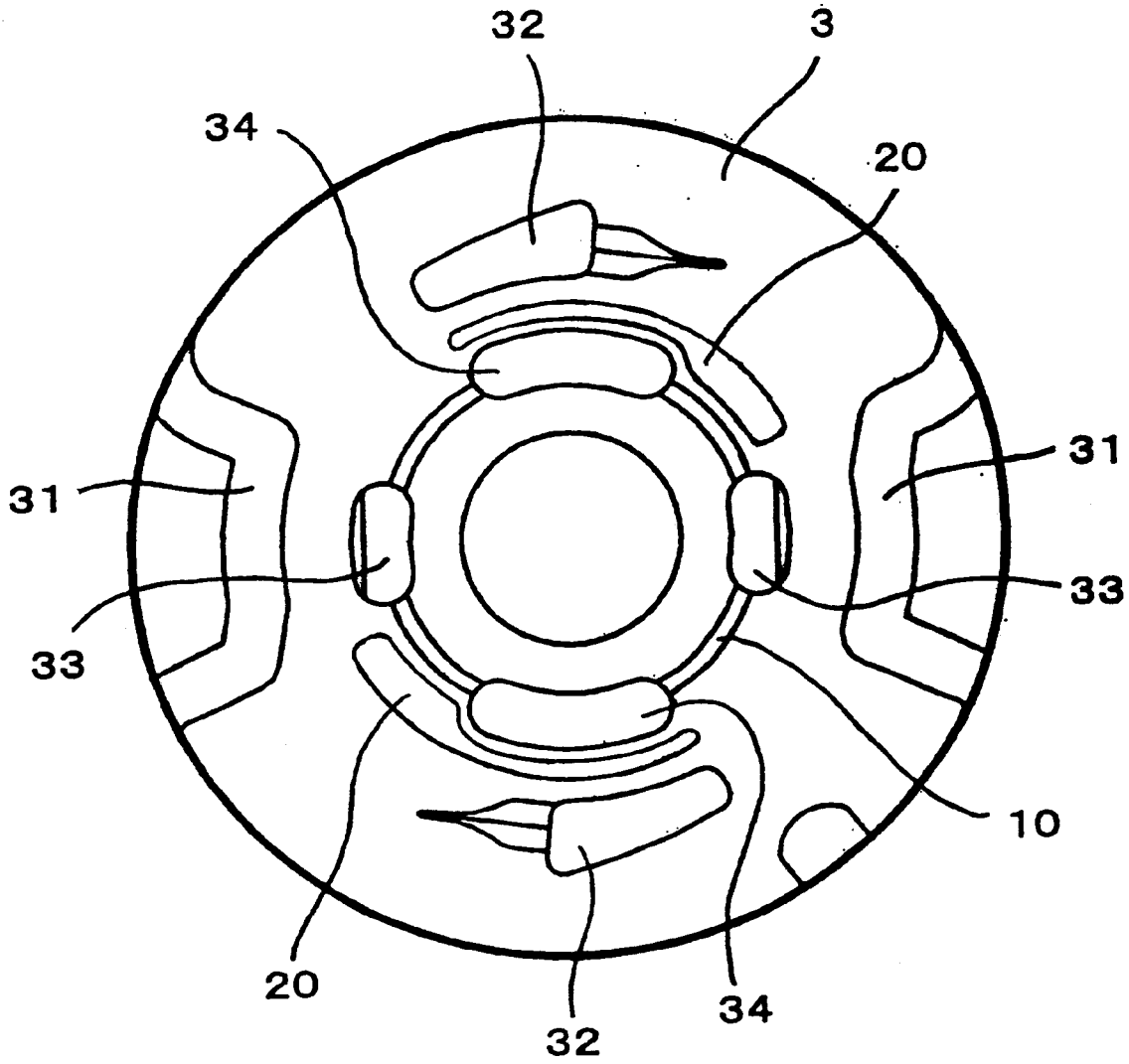
FIG. 8 is a top plan view of a side plate according to a third embodiment of the present invention.

Finally, a third embodiment according to the present invention will be explained hereinafter with reference to FIG. 8.

Basically, the depression such the wide portion 82 is formed to reduce the contact areas of the vane 6 with the rear housing and the side plate 3, and however it is not necessary to introduce the pressure into the depression. Accordingly, as described in the prior two embodiments, the depression (the wide portion 82 and/or the annular communication passage 9) is not indispensably communicated with the backpressure grooves 33 and 34. Namely, a communication passage 10 is formed for pressure communication between the backpressure grooves 33 and 34, and a depression groove 20 independent of the communication groove 10 having a narrow portion as constructed in the conventional vane pump is provided as a depression on preferable portions of the rear housing 2 and the side plate 3. With this configuration, the operation in the third embodiment can be obtained as that similar to the first and second embodiments. The depression grooves 20 are independently formed as shown in FIG. 8. However, the depression groove 20 may be uniformly formed continuously in the circumferential direction.

Besides, in either cases, a radial width of the depression groove 20 existing at areas corresponding to the backpressure grooves 33 and 34 is formed to be smaller than that of the other portions to keep the ability in seal with suction port 31 and the discharge port 32.

In each of the first, second and third embodiments as constructed above, the depressions (the wide portion 82, the annular communication passage 9 and/or the depression groove 20) are respectively provided on both the rear housing 2 and the side plate 3. However, the depression may be provided on either the rear housing 2 or the side plate 3. In such a situation, the ability in projection of the vane can be sufficiently obtained.

Obviously, numerous modifications and variations of the present invention are possible in light of the above teachings. It is therefore to be understood that within the scope of the appended claims, the present invention may be practiced otherwise than as specifically described herein.

What is claimed is:

1. A vane pump comprising:

a rotor that is rotatably disposed in a cam ring attached to a housing;

a plurality of vanes that are slidably disposed in corresponding slits formed in the rotor, said vane is configured to projected from the slit upon rotation of the rotor;

a pair of sidewall members that close both side portions of the cam ring to form a cavity defined by the cam ring and said sidewall members;

a plurality of annular backpressure grooves that are depressively formed on contact surfaces of said sidewall members with the rotor, adjacent two of the backpressure grooves are configured to be communicated with each other through a communication passage to introduce discharged pressure into an inside end portion of each of the slits; and depressions that are formed on at least one of the contact surfaces of with said side wall members of the rotor, said depressions are configured to not contact a part of side surface of each of the vanes.

2. A vane pump according to claim 1, wherein each of said depressions is formed radially outside of the backpressure groove within a range at least where the backpressure groove is formed in a circumferential direction of the rotor.

3. A vane pump according to claim 1, wherein each of said depressions is formed in an entire circumferential area from a pre-compression area of the pump to a discharge area adjacent thereto in a rotational direction of the rotor.

4. A vane pump according to claim 1, wherein said depression is continuously formed in the circumferential direction.

5. A vane pump according to each of claims 1–4, wherein said depression is formed so as to be communicated with said backpressure groove or the communication passage.

6. A vane pump according to claim 2, wherein each of said depressions is formed in an entire circumferential area from a pre-compression area of the pump to a discharge area adjacent thereto in a rotational direction of the rotor.

7. A vane pump according to claim 6, wherein said depression is formed so as to be communicated with said backpressure groove or the communication passage.

8. A vane pump according to claim 2, wherein said depression is continuously formed in the circumferential direction.

9. A vane pump according to claim 8, wherein said depression is formed so as to be communicated with said backpressure groove or the communication passage.

* * * * *